US010991183B2

(12) United States Patent
Glogovsky et al.

(10) Patent No.: US 10,991,183 B2
(45) Date of Patent: Apr. 27, 2021

(54) WIRELESS LOCK SYSTEM

(71) Applicant: SA Consumer Products, Inc., Leawood, KS (US)

(72) Inventors: Richard S. Glogovsky, Libertyville, IL (US); Ben Lavallee, McDonald, PA (US); Paul Hunt, Lake Zurich, IL (US)

(73) Assignee: SA Consumer Products, Inc., Leawood, KS (US)

( * ) Notice: Subject to any disclaimer, the term of this patent is extended or adjusted under 35 U.S.C. 154(b) by 0 days.

(21) Appl. No.: 16/560,726

(22) Filed: Sep. 24, 2019

(65) Prior Publication Data

US 2021/0090368 A1 Mar. 25, 2021

(51) Int. Cl.

| | |
|---|---|
| ***G07C 9/00*** | (2020.01) |
| ***E05G 1/10*** | (2006.01) |
| ***E05B 47/00*** | (2006.01) |

(52) U.S. Cl.

CPC ..... *G07C 9/00912* (2013.01); *E05B 47/0001* (2013.01); *E05G 1/10* (2013.01)

(58) Field of Classification Search

CPC ..... G07C 9/00912; G07C 9/00309; G07C 2009/00769; E05B 47/0001; E05G 1/005

USPC ..... 340/5.2

See application file for complete search history.

(56) References Cited

U.S. PATENT DOCUMENTS

| | | | | |
|---|---|---|---|---|
| 5,083,122 | A | 1/1992 | Clark | |
| 5,219,386 | A | 6/1993 | Kletzmaier et al. | |
| 5,701,828 | A | 12/1997 | Benore et al. | |
| 6,040,771 | A | 3/2000 | Kim | |
| 6,081,199 | A | 6/2000 | Hogl | |
| 6,116,067 | A * | 9/2000 | Myers | B25H 3/028 292/341.16 |
| 6,384,407 | B1 | 5/2002 | Frank | |
| 2003/0140665 | A1 | 1/2003 | Szuminski et al. | |
| 2006/0201215 | A1 | 9/2006 | Wolf | |
| 2007/0171060 | A1 | 7/2007 | Trent et al. | |
| 2008/0256991 | A1 | 10/2008 | Goldman | |
| 2008/0296912 | A1 * | 12/2008 | Whitner | E05B 47/0012 292/144 |
| 2010/0020389 | A1 * | 1/2010 | Schmidt | G02B 7/22 359/350 |
| 2010/0072351 | A1 * | 3/2010 | Mahowald | G01J 1/02 250/214 AL |

FOREIGN PATENT DOCUMENTS

| | | |
|---|---|---|
| CN | 101882332 | 11/2010 |
| WO | WO2018000117 | 1/2018 |

OTHER PUBLICATIONS

Zoter Infrared Sensor Detector Magnetic Door Lock Automatic Unlock, Amazon.com (Electronics/Security & Surveillance/Home Security Systems), Item Model No. EDL-ML-YM-280IS.

* cited by examiner

*Primary Examiner* — Vernal U Brown

(74) *Attorney, Agent, or Firm* — Erickson Kernell IP, LLC

(57) ABSTRACT

A system for securing a protected area (such as an internal compartment of a safe) by locking an operable opening (such as a door) in a closed position. The invention comprises a wireless lock system that may include an input apparatus located on the outside of the protected area that communicates wirelessly with other components of the lock system located inside the protected area. Various wireless technologies may be employed including, for example, infrared communication.

20 Claims, 5 Drawing Sheets

WIRELESS LOCK SYSTEM

FIELD

The present invention relates generally to systems for locking safes and the like. More specifically, the invention relates a wireless lock system comprising a user input apparatus on the outside of a protected area that communicates wirelessly with a lock mechanism located inside the protected area.

BACKGROUND

Many modern lock systems for safes and other secure areas are electrically powered. In such systems, some or all the components require electricity to function. One benefit of electrically powered systems is that components in the system can communicate with each other by sending and receiving various types of signals. When a component receives a signal, the component can then take some type of action. Signals between components in an electrically powered lock system often take the form of a digital or analog signal sent from one component to another via a wired connection.

A problem with electrically powered lock systems is the potential for failure of one or more wires. Of particular concern is a mechanical failure of the wire running between an input device such as an electronic keypad and the main circuit board. This wire has historically had a relatively high rate of failure due to recurring movement of the input device (whether it is changing batteries in a keypad or disassembling the input device for troubleshooting). The security industry has been plagued by mechanical failure of this type of wire, and it has been one of the main reasons electrical lock system stop functioning. Mechanical failure of this nature can occur when a soldered connection at the end of a wire fails due to mechanical stress, or it can be caused when an insulative jacket on the wire is worn away due to contact with the wire's surroundings which can result in a short circuit.

Thus, there remains a need in the art for an improved electrical lock system. The present invention addresses this need.

SUMMARY

Embodiments of the invention are defined by the claims, not this summary. A high-level overview of various aspects of the invention is provided here to introduce a selection of concepts that are further described in the detailed description section below. This summary is not intended to identify key features or essential features of the claimed subject matter, nor is it intended to be used in isolation to determine the scope of the claimed subject matter.

The present invention is directed to a lock system for securing a protected area (such as an internal compartment of a safe) by locking an operable opening (such as a door) in a closed position. The lock system may include a user input apparatus in a location that is accessible outside the protected area when the operable opening is closed. One such location may be on the outside surface of the operable opening. There may also be a wireless signal emitter in electrical communication with the user input apparatus. As used herein, the term electrical communication includes being wired directly or indirectly to a component such that electricity or a signal could be transferred along a physical medium from one component to another.

The lock system may also include a processor that activates one or more components of the lock system in response to user input entered into the input apparatus. The processor location can vary although in a preferred embodiment, the processor is inaccessible from outside the protected are when the operable opening is closed. There may also be a wireless signal receiver in electrical communication with the processor and adapted to receive a wireless signal (an infrared signal for example) sent by the wireless signal emitter. The wireless signal sent by the wireless signal emitter may pass unimpeded (i.e., without physical barrier) through a channel before being received by the wireless signal receiver. The channel may extend at least partially through the operable opening. There may be a sleeve positioned in the channel and the sleeve may be cylindrical or tubular with any number of cross-sectional shapes (e.g., square, oval, or triangular). The lock system may be powered by one or more batteries and the user input apparatus may include a battery compartment.

The present invention is also directed to a unique user input apparatus for a lock system that is designed to secure a protected area (such as an internal compartment of a safe) by locking an operable opening (such as a door) in a closed position. The operable opening may include an opening through which components of the lock system can communicate when the operable opening is in a closed position.

The user input apparatus may include a body portion mounted to a surface of the operable opening that is outside the protected area when the operable opening is in a closed position. The body may cover at least a portion (i.e., some or all) of the opening that is formed in the operable opening, as determined from the perspective of a user standing in front of the operable opening. There may be a user interface attached to the body for generating an unlock instruction based on user input (such as a passcode or a biometric reading). The user input apparatus may also include a wireless signal emitter adapted to communicate the unlock instruction to at least one additional component of the lock system by sending a wireless signal (e.g., an infrared signal) based on the unlock instruction. The wireless signal emitter may be mounted to the body and be in alignment with the opening in the operable opening such that a wireless signal sent by the wireless signal emitter can pass unimpeded (i.e., without physical barrier) into the opening.

The body may include a backplate having a hole through which a wireless signal passes before entering into the opening in the operable opening. The user input apparatus may have an annular sidewall that is removably securable to the backplate. The device may be battery powered and have a battery compartment that is accessible by removing the annular sidewall from the backplate.

DETAILED DESCRIPTION OF EXEMPLARY EMBODIMENTS

Various embodiments of the present invention are disclosed herein, it is to be understood that the disclosed embodiments are merely exemplary of the invention, which may be embodied in various forms. Thus, any specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology used in the following description is for convenience in reference only and is not limiting. For example, the words "vertically," "horizontally," "vertical," "horizontal" and "upwardly," "downwardly," "upper," "lower" all refer to the depicted position of the element or embodiment to which the reference is made. The words "inwardly" and "outwardly" refer to directions toward and away from, respectively, the geometric center of the embodiment being designated and parts thereof. The terminology used herein may include the words specifically mentioned, derivatives thereof and words of a similar import. It is further understood that terminology such as the aforementioned directional phrases may be used to describe exemplary embodiments of the lock system or its components as shown in the figures herein. This is for convenience only as it is understood that the exemplary embodiments of the system and components described may also be used in other orientations.

Figure 1:
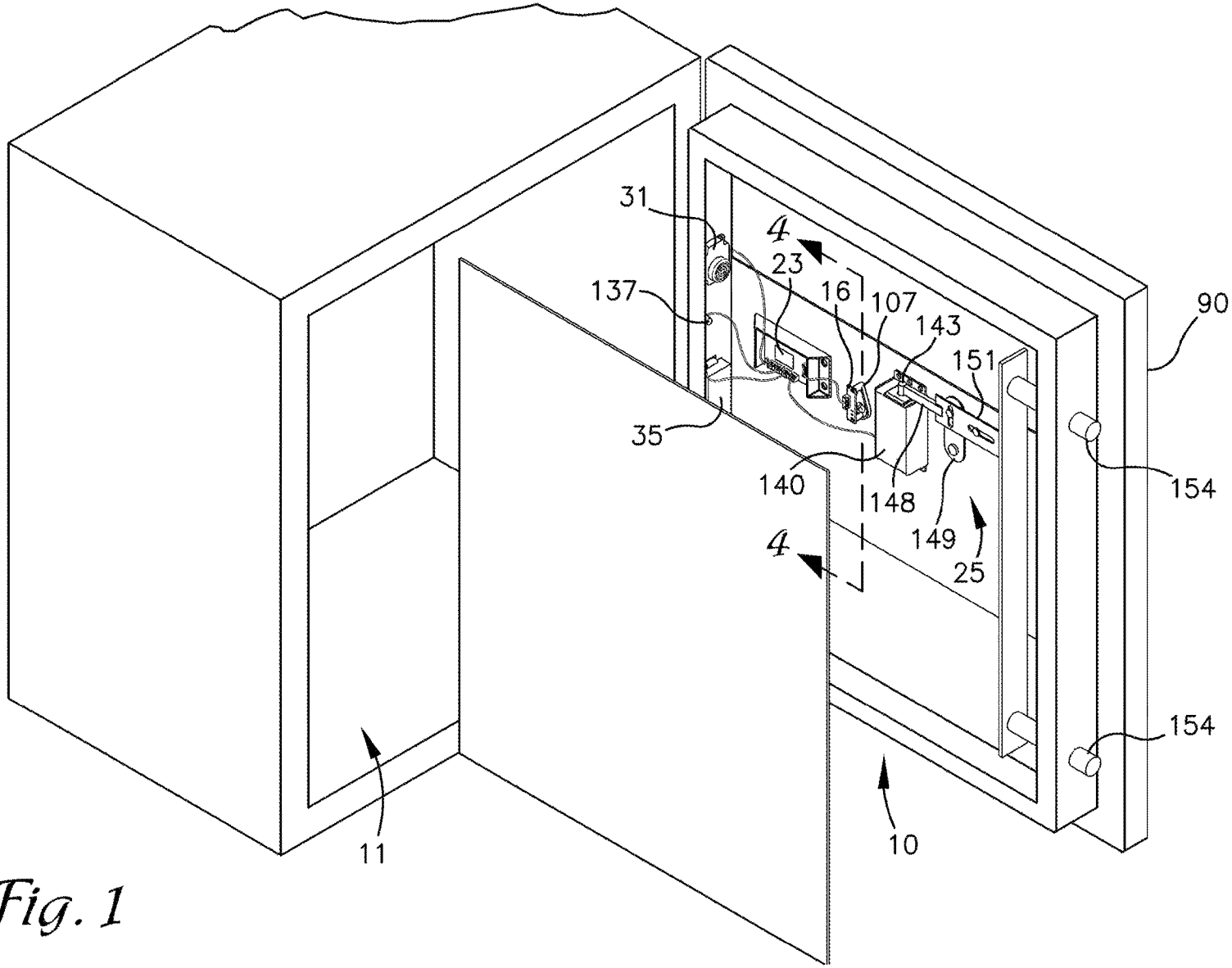
FIG. 1 is front perspective view of a safe with an open door showing a first embodiment of the wireless lock system in accordance with the present invention.
Figure 2:
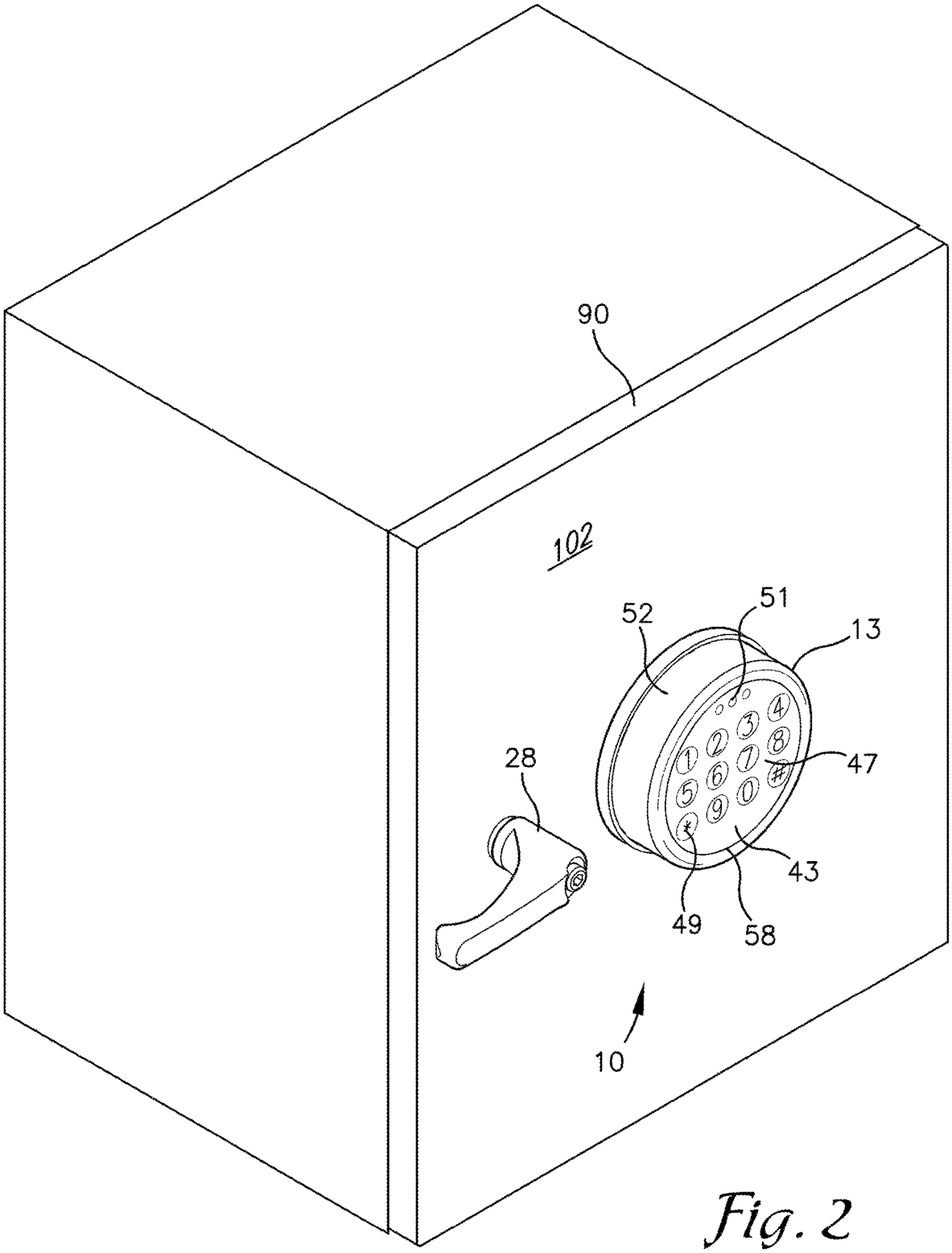
FIG. 2 is a front perspective view of the safe of FIG. 1 in a closed configuration.
Figure 3:
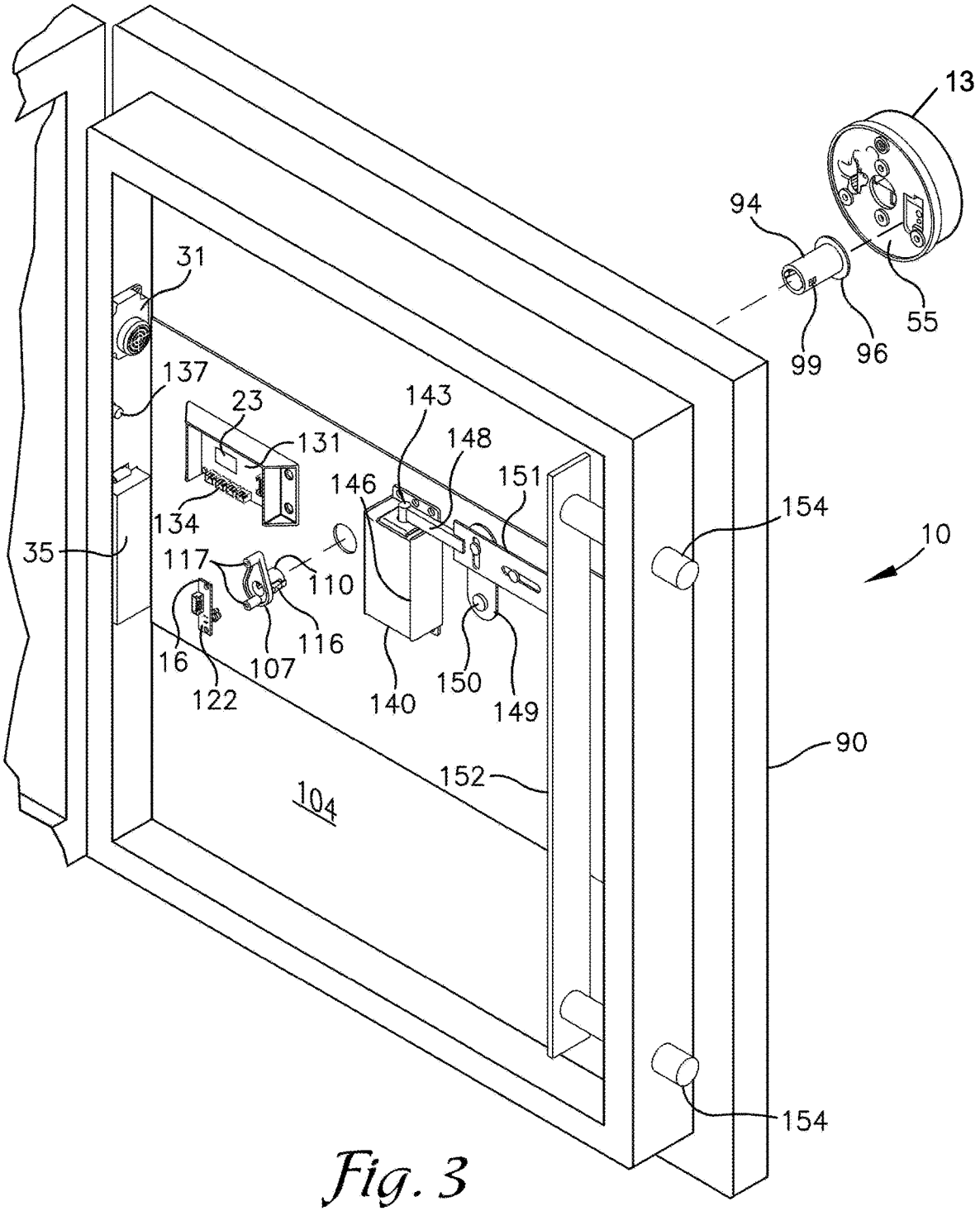
FIG. 3 is a partial exploded view of the wireless lock system of FIG. 1.
Figure 4:
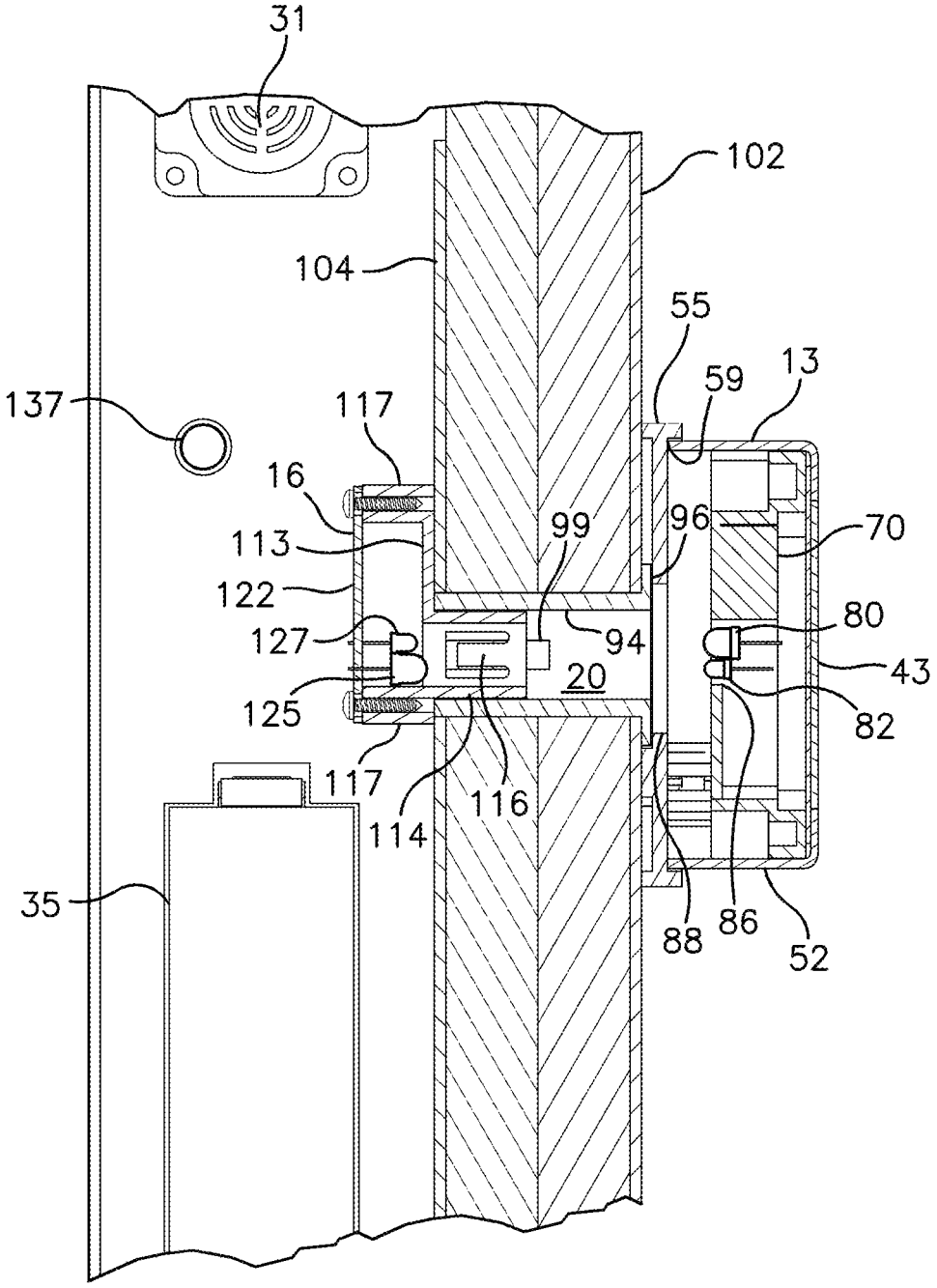
FIG. 4 is an enlarged partial cross-sectional view of the wireless lock system taken along line 4-4 in FIG. 1.

Referring initially to FIGS. 1, 2 and 3, a wireless lock system in accordance with an exemplary embodiment of the present invention is referenced generally by the numeral 10. Wireless lock system 10 may be used to place an operable opening (such as a door) in a locked or unlocked state to secure or provide access to a protected area or space 11. The wireless lock system 10 comprises a user input apparatus 13 and a wireless receiver module 16 communicating through an internal passage or channel 20 (FIG. 4). Lock system 10 includes a processor 23 to activate or deactivate a lock mechanism 25 based on whether a user entered an authorized passcode into user input apparatus 13. Finally, lock system 10 may include components such as a handle 28, siren 31 and power supply such as a battery 35.

Figure 6:
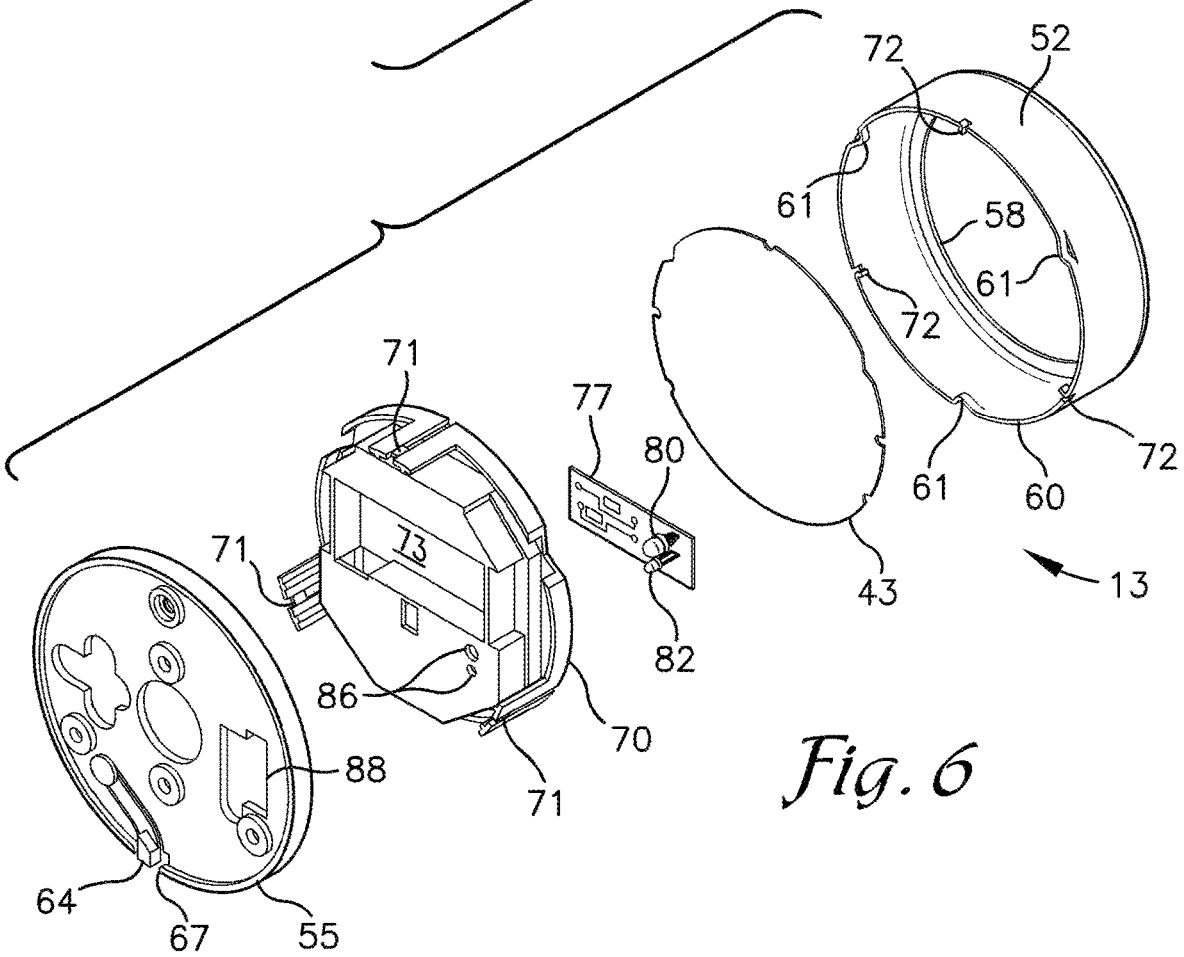
FIG. 6 is an exploded view of the wireless keypad shown in FIG. 3.

As shown in FIGS. 2, 3 and 6, user input apparatus 13 of lock system 10 may comprise a puck-shaped device having a face 43. Face 43 may include a user interface such as a keypad 47 having an arrangement of keys 49 laid out in a matrix or grid pattern. A user can utilize the keypad to provide an input or instruction to lock system 10 by entering a passcode. The passcode may function as an instruction to lock or an instruction to unlock or both depending on the state of the lock system 10. Each key 49 bears an alphanumeric designation such as a letter, number, or symbol. For example, as shown in FIG. 2, there may be three rows of four keys 49 where the keys bear the numbers and symbols found on a conventional telephone keypad (numbers 0-9 and the symbols * and #). It is foreseen that other designations may also be used, such as various characters, letters, numbers, symbols, pictures or colors. The characters, letters, numbers, and symbols on keys 49 may be taken from various languages or cultures. Keys 49 may be all be characters, letters, numbers, symbols, pictures or colors, or they may be a combination of those things. It is also foreseen that keys 49 may be arranged in any number of ways, including a grid, circular, rectangular, or even a seemingly random arrangement.

Keys 49 may be integrated into keypad 47 such that they are touch sensitive. A touch sensitive display may include any number of touch screen technologies known in the art (e.g., capacitive or resistive touchscreens). The keys 49 could also be physical keys or buttons that are raised from the keypad 47 and register a keystroke when the button is pressed. It is foreseen that, in lieu of keypad 47 and keys 49, user input apparatus 13 could utilize a biometric scanning device (e.g., fingerprint or retinal scan) to determine whether a user is authorized to activate or deactivate lock system 10.

Face 43 of user input apparatus 13 may include a series of signal lights 51 to provide information to a user. The signal lights 51 may each be a different color, such as one red, one green, one yellow, and the lights 51 could illuminate to signal different conditions of the lock system 10 to a user. For example, one light 51 may be red and illuminate if the user enters an incorrect unlock code or is otherwise unauthorized to activate or deactivate lock system 10. Another light 51 may be green and illuminate if the user enters a correct unlock code or is otherwise authorized to activate or deactivate lock system 10. A third light 51 may be yellow and illuminate if there is a problem with lock system 10. It is foreseen that any number of signal lights 51 may be used and different types of alerts given. For example, it may be desirable to use one light 51 and provide information to a user through different blinking patterns (e.g., solid light, slow blinking, fast blinking). Lights 51 may be multi-color LEDs capable of changing colors as desired. It is also foreseen that lights 51 could be used to illuminate text or, in lieu of signal lights 51, text could be displayed on face 43 to provide information to a user.

As shown on FIGS. 4 and 6, user input apparatus 13 comprises an annular sidewall 52 extending rearward from the perimeter of face 43 towards a backplate 55. Sidewall 52 may have a lip 58 extending inwardly from the front edge of the sidewall 52. Face 43 may be retained in place by lip 58 overlapping the perimeter of face 43. Face 43 may be separable from sidewall 52 or it can be attached to sidewall 52 with an adhesive, fasteners, or some other method.

In one embodiment, sidewall 52 is removably securable to a backplate 55. As shown in FIG. 4, backplate 55 may include a track or groove 59 that approximates the size and shape of the rear edge 60 of sidewall 52. When sidewall 52 is secured to backplate 55, the rear edge 60 of sidewall 52 is positioned in groove 59. As best seen on FIG. 6, sidewall 52 may have one or more catches 61 protruding inwardly along the rear edge 60. Backplate 55 may have one or more flexible members or pawls 64 to engage with catches 61. Backplate 55 may also have one or more stops 67 that correspond to catches 61.

To secure sidewall 52 to backplate 55, sidewall 52 may be placed against backplate 55 such that edge 60 is seated in grove 59. Sidewall 52 can be rotated with respect to backplate 55 until a catch 61 on sidewall 52 encounters a stop 67 on backplate 55, at which point sidewall 52 can no longer rotate. While both parts are being rotated, pawls 64 bend inwardly as they move over their respective catches 61 and then straighten and rest in place past the catches 61. When the pawls 64 are in place past the catches 61, sidewall 52 is secured to backplate 55. Each pawl 64 may have a member that can be pressed to release the pawl 64 from its stop 67 to allow the sidewall 52 to be rotated in an opposite direction and removed from backplate 55. Depending on the application, there may be special tools or keys necessary to allow removal of sidewall 52 from backplate 55.

As best seen in FIGS. 4 and 6, user input apparatus 13 includes an internal support 70. Support 70 is located within user input apparatus 13 between backplate 55 and face 43. In one embodiment, support 70 is generally circular and sized to approximate the diameter and thickness of sidewall 52. Support 70 may fit snuggly inside user input apparatus 13 such that there is a friction fit with sidewall 52. Alternatively, support 70 may include clips 71 that engage with corresponding catches 72 on sidewall 52. Support 70 comprises an internal battery compartment 73 and a mount for an electronic circuit board 77. The circuit board 77 can be a printed circuit board that mechanically supports and electrically connects electronic components. Face 43 can be secured to internal support 70 with an adhesive or fasteners instead of securing face to sidewall 52 if desired.

Electrically connected to electronic circuit board 77 may be an infrared ("IR") emitter 80 and receiver 82 for example. There are different types of IR emitters and receivers, and it is foreseen that various types can be used. An IR emitter typically comprises a two or three pin light emitting diode which includes a bulb and connector pins. An IR receiver similarly includes a bulb and connector pins, but it is typically a photodiode rather than a light emitting diode. The exact type of IR emitter and receiver will depend on the size and configuration of lock system 10. As an alternative to IR, microwave, Bluetooth®, or wifi transceivers may be used and connected to the electronic circuit board 77.

Also connected to circuit board 77 is keypad 47 and signal lights 51. Input from a user (such as a code entered on keypad 47) is converted into an IR signal that can be transmitted by IR emitter 80. Infrared signals are generated by an emitter flashing patterns of infrared light which can be decoded by the receiver. An IR signal received by IR receiver 82 is converted to a digital or analog signal that can be sent over wired connections and transferred to other components as necessary. For example, receiver 82 may receive an IR signal to illuminate signal lights 51 on face 43. The IR signal would then be converted by receiver 82 and its associated circuitry into a signal to turn on signal lights 51.

As best seen in FIGS. 4 and 6, IR emitter 80 and receiver 82 are positioned such that they face the rear of user input apparatus 13 (toward backplate 55) and have a direct line of sight into channel 20. There is one or more openings 86 in support 70 aligned with emitter 80 and receiver 82, and there are one or more openings 88 in backplate 55 aligned with emitter 80 and receiver 82. In other words, IR emitter 80 and receiver 82 are able to send and receive IR signals unimpeded through channel 20. Openings 86 and 88 align to form a pathway in which emitter 80 and receiver 82 can send and receive IR signals unimpeded. In certain applications, the color of materials in the vicinity of IR emitter 80 and receiver 82 may impact performance. Accordingly, lighter colored materials (such as white) may improve performance. This does not mean that darker materials cannot be used, but if performance of IR emitter 80 and receiver 82 is lacking, using lighter colored materials in their vicinity may improve performance.

As shown in FIG. 2, user input apparatus 13 may be located on an operable opening such as a door 90 or wall of protected space 11. To mount user input apparatus 13 to door 90, first backplate 55 is fastened (or adhered) to door 90. Then sidewall 52 is removably secured to backplate 55 is explained above, with keypad 47, support 70, electronic circuit 77, IR emitter 80 and receiver 82 all located within user input apparatus 13 as described above. Sidewall 52, backplate 55, and support 70 may collectively be considered the body of user input apparatus 13.

As shown in FIG. 4, A channel 20 is formed through door 90 directly behind backplate 55 in alignment with opening 88 in backplate 55, opening 86 in support 70, and IR emitter 80 and receiver 82. IR signals can be passed through door 90 unimpeded via channel 20. That is, channel 20 allows IR signals to be passed from outside protected space 11 into protected space 11 through channel 20. As best seen in FIGS. 3 and 4, channel 20 may comprise a cylindrical or similar tubular sleeve 94 having a flange 96 on a first end and one or more slots 99 for receiving one or more clips proximate the second end. The length of sleeve 94 approximates the thickness of door 90. When installed in door 90, flange 96 is adjacent the exterior surface 102 of the door and the second end of sleeve 94 is adjacent the interior surface 104 of the door.

Figure 5:
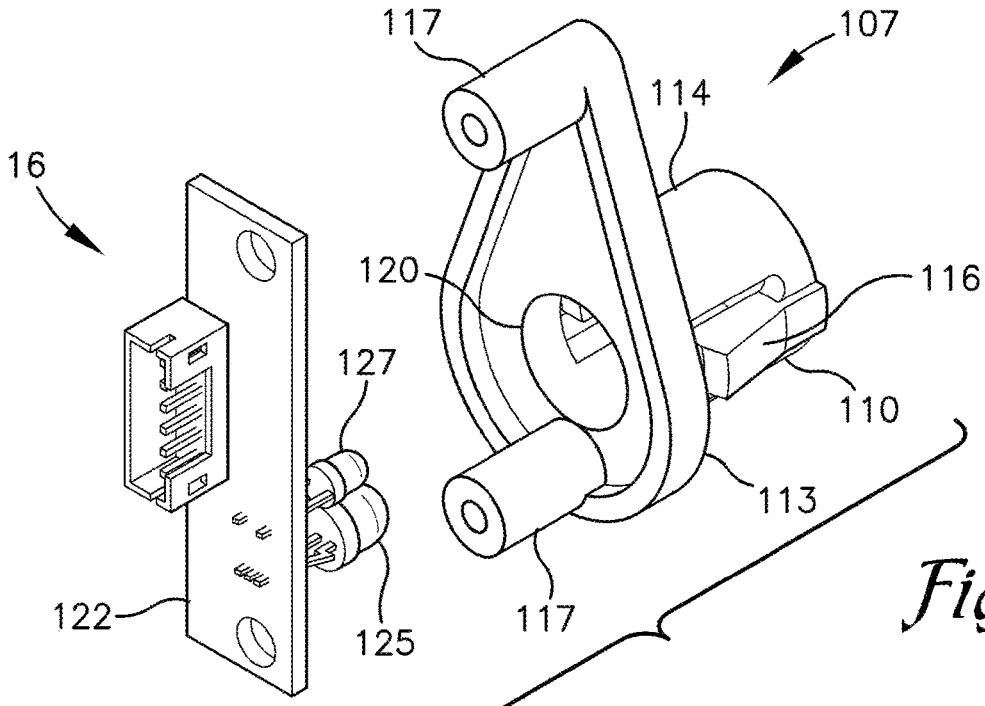
FIG. 5 is an enlarged perspective view of a wireless receiver module and mounting bracket shown in FIG. 3.

As best seen in FIGS. 3 and 5, a mounting bracket 107 is aligned with sleeve 94 and located adjacent the interior surface 104 of door 90. Mounting bracket 107 comprises an annular insert 110 extending from a support section 113. Insert 110 includes a sidewall 114 surrounding a void through which an IR signal may pass. As shown in FIG. 4, The outer diameter of insert 110 is slightly smaller than the inner diameter of sleeve 94. Insert 110 is sized to slide sidewall 114 into the second end of sleeve 94. Insert 110 includes one or more flexible clips 116 for engaging slots 99 formed in sleeve 94. Clips 116 may be designed to bend inward when sidewall 114 is sliding into sleeve 94, and then flexing outward and locking into place when seated in slots 99. When clips 116 are seated in slots 99, mounting bracket 107 is secured to sleeve 94. When mounting bracket 107 is secured to sleeve 94, both are mounted to door 90. When they are mounted to door 90, sleeve 94 is positioned in channel 20 and insert 110 is positioned in sleeve 94; door 90 is then sandwiched between support section 113 of mounting bracket 107 and flange 96 of sleeve 94.

Attached to support section 113 of mounting bracket 107 is a pair of mounting posts 117. Each mounting post 117 has a threaded hole or pilot hole for receiving a threaded fastener. There is an opening 120 between posts 117 in support section 113 that opens into the void of insert 110. Wireless receiver module 16 may be attached to mounting posts 117 in alignment with opening 120.

As shown in FIG. 5, wireless receiver module 16 comprises an electronic circuit board 122. Circuit board 122 can be a printed circuit board that mechanically supports and electrically connects electronic components. Electrically connected to electronic circuit board 122 is an IR emitter 125 and receiver 127. An IR signal received by IR receiver 127 is converted to a digital or analog signal that can be sent over wired connections and transferred to other components as necessary. Signals from other components can be converted into an IR signal that can be transmitted by IR emitter 125. In certain applications, the color of materials in the vicinity of IR emitter 125 and receiver 127 may impact performance.

Wireless receiver module 16 is mounted on mounting bracket 107 such that IR emitter 125 and receiver 127 have a direct line of sight through opening 120 and into channel 20 of the door. Because components of the lock system 10 can communicate wirelessly via IR, the need for physical wires is minimized. In particular, there is no need to run a wire through door 90 because IR signals can be passed unimpeded back and forth through channel 20 between emitter 125/receiver 127 inside protected space 11 and emitter 80/receiver 82 outside protected space 11. When wireless receiver module 16 is properly mounted, emitter 125 and receiver 127 each have a line of sight through opening 120 (of support section 113), channel 20 (through door 90), openings 88 (of backplate 55), and openings 86 (in support 70) to emitter 80 and receiver 82.

As shown in FIG. 3, lock system 10 also includes a processor 23 located in protected space 11. Processor 23 is attached to a motherboard or main circuit board 131, which is mounted to interior surface 104 of door 90. Main circuit board 131 can be a printed circuit board that mechanically supports and electrically connects electronic components. Main circuit board 131 includes several cable sockets or connectors 134 for receiving electrical connector cables from other components of lock system 10. When other components are connected to a connector 134 on main circuit board 131, the components are electrically connected to processor 23 mounted on the board. Processor 23 can send and receive electrical signals to and from the various connected components. Main circuit board 131 may include connectors 134 for any number of components including wireless receiver module 16, battery 35, siren 31, lock mechanism 25, and a reset button 137.

Processor 23 may be any type of processor known in the art, however, a flash memory microprocessor type tends to be well suited for this application. Processor 23 can be programmed to receive, analyze, and send digital or analog signals relating to components connected to the main circuit board 131. The specific aspects of the processor 23 program will depend on the way in which lock system 10 is intended to function. For example, processor 23 may be programmed to send a "lock" signal to engage lock mechanism 25 when a approved signal is received from wireless receiver module 16 and an "unlock" signal to disengage lock mechanism 25 when a different approved signal is received from wireless receiver module 16. The signals sent from wireless receiver module 16 to processor 23 would, of course, correspond to the IR signal the wireless receiver module 16 received from user input apparatus 13. In other words, if user input apparatus 13 sends an authorized "unlock" code via IR to wireless receiver module 16, wireless receiver module will send a corresponding signal to processor 23, which will in turn send an "unlock" signal to lock mechanism 25 to unlock door 90.

Processor 23 may be programmed to analyze and act upon any number of signals. For example, it may activate siren 31 if certain conditions are met or a break-in condition is detected. Processor 23 may also send signals to user input apparatus 13 via wireless receiver module 16 to illuminate signal lights 51 so that the system can communicate with a user. In situations like reprogramming a lock code or identifying a low battery, processor 23 can send a signal to wireless receiver module 16, which would send an IR signal to the user input apparatus 13 to illuminate certain signal lights 51. These are just a few examples of the signals that can be sent, received, and/or analyzed by processor 23.

As shown in FIGS. 1 and 3, lock system 10 also comprises a lock mechanism 25 located on the interior surface 104 of door 90. Lock mechanism 25 includes a lock actuator such as a solenoid lock or motor 140. Solenoid lock 140 may be any type that is known in the art and used in lock systems. Solenoid lock 140 may be electrically powered and include a retractable member 143 extending from a body 146. The retractable member 143 extends to engage a rod 148 which is connected to linkage 151 for bolt assembly 152. When retractable member 143 is extended, rod 148 (and bolt assembly 152) is prohibited from moving and lock mechanism 25 is in a locked state. When member 143 is retracted, rod 148 is free to move and lock mechanism 25 is in an unlocked state.

Rod 148 is attached to one end of linkage 151. The other end of linkage 151 is attached to bolt assembly 152. Linkage 151 is also secured to a rotating arm 149 such that when arm 149 is rotated, bolt assembly 152 moves linearly to either extend or retract bolts 154 from the side of door 90. By extending bolts 154 when the door 90 is closed, the bolts 154 are received in the door frame so that the door 90 is locked closed. When bolts 154 are retracted, the door 90 can be opened or closed freely.

Rotating arm 149 is mounted proximate the interior surface 104 of door 90 and attached to a spindle 150. Spindle 150 passes through door 90 and is also attached to handle 28 which is on the exterior surface 102 of door 90 (FIG. 2). If handle 28 is turned to unlock door 90, spindle 150 rotates and causes arm 149 to also rotate. However, if the retractable member 143 is extended (i.e., in a locked state) and engaged with rod 148, arm 149 is not be allowed to rotate, which would also keep spindle 150 and handle 28 from rotating.

Finally, lock system 10 may include other components typically found in safes such as a siren 31 and reset button 137. Siren 31 can sound an alert if a break-in condition is identified. Reset button 137 may be used to reset some or all the settings for the lock system 10 to their original state. This might be useful if a component is malfunctioning or if a unlock passcode is forgotten.

It should be understood that while certain forms and embodiments have been illustrated and described herein, the present invention is not to be limited to the specific forms or arrangement of parts described and shown, and that the various features described may be combined in ways other than those specifically described without departing from the scope of the present invention.

The terms "substantially," "generally," "approximately," or any other qualifying term as used herein may be applied to modify any quantitative representation, which could permissibly vary without resulting in a change to the basic function to which it is related.

Having thus described the invention, what is claimed as new and desired to be secured by Letters Patent is:

1. A lock system for securing a protected area by locking an operable opening in a closed position, the lock system comprising:

a user input apparatus mounted to a surface outside of the protected area, wherein said user input apparatus includes a keypad;

a wireless signal emitter in electrical communication with said user input apparatus;

a processor mounted in the protected area, wherein said processor activates components of the lock system in response to an input into said user input apparatus;

a wireless signal receiver in electrical communication with said processor and adapted to receive a wireless signal sent by said wireless signal emitter; and a channel through which said wireless signal sent by said wireless signal emitter to said wireless signal receiver can pass unimpeded.

2. The lock system of claim 1, wherein said channel extends at least partially through the operable opening.

3. The lock system of claim 2, wherein said user input apparatus is mounted on the operable opening.

4. The lock system of claim 3, wherein said lock system is powered by one or more batteries.

5. The lock system of claim 4, wherein said user input apparatus includes a battery compartment.

6. The lock system of claim 5, wherein said wireless signal sent by said wireless signal emitter is an infrared signal.

7. The lock system of claim 6, further comprising a tubular sleeve positioned in said channel.

8. A user input apparatus for a lock system that is designed to secure a protected area by locking an operable opening in a closed position:

a body mounted to a surface of the operable opening, said surface being outside the protected area when the operable opening is in a closed position, said body covering at least a portion of an opening formed in said surface;

a user interface attached to said body, said user interface adapted to generate an unlock instruction; and a wireless signal emitter adapted to communicate said unlock instruction to at least one additional component of the lock system by sending a wireless signal based on said unlock instruction, said wireless signal emitter mounted to said body in alignment with said opening formed in said surface such that said wireless signal passes unimpeded into said opening.

9. The user input apparatus of claim 8, wherein said body comprises a backplate.

10. The user input apparatus of claim 9, wherein said backplate includes an opening through which said wireless signal passes before entering into said opening formed in said surface.

11. The user input apparatus of claim 10, wherein said wireless signal is an infrared signal.

12. The user input apparatus of claim 11, further comprising a battery compartment.

13. The user input apparatus of claim 12, further comprising an annular sidewall removably securable to said backplate.

14. The user input apparatus of claim 13, wherein said battery compartment is accessed by separating said annular sidewall from said backplate.

15. A lock system for securing a protected area by locking an operable opening in a closed position, the lock system comprising:

a user input apparatus mounted to a surface outside of the protected area, said user input apparatus including a user interface for generating an unlock instruction, wherein said user interface includes a keypad;

a wireless signal emitter mounted to said user input apparatus, said wireless signal emitter adapted to communicate said unlock instruction to at least one additional component of the lock system by sending a wireless signal based on said unlock instruction;

a processor inaccessible from outside the protected area when the operable opening is closed, wherein said processor activates components of the lock system in response to said unlock instruction;

a wireless signal receiver in electrical communication with said processor and adapted to receive said wireless signal sent by said wireless signal emitter; and a channel in alignment with said wireless signal emitter and said wireless signal receiver, said channel positioned such that said wireless signal sent by said wireless signal emitter passes unimpeded through said channel to said wireless signal receiver.

16. The lock system of claim 15, wherein said wireless signal sent by said wireless signal emitter is an infrared signal.

17. The lock system of claim 16, wherein said user input apparatus is mounted on the operable opening.

18. The lock system of claim 17, wherein said lock system is powered by one or more batteries.

19. The lock system of claim 18, wherein said user input apparatus includes a battery compartment.

20. The lock system of claim 19, further comprising a sleeve positioned in said channel.

* * * * *